US009328487B2

(12) United States Patent
Wernke

(10) Patent No.: US 9,328,487 B2
(45) Date of Patent: May 3, 2016

(54) BUBBLE FAUCET

(71) Applicant: Thomas A. Wernke, Cincinnati, OH (US)

(72) Inventor: Thomas A. Wernke, Cincinnati, OH (US)

(73) Assignee: Thomas A Wernke, Cincinnati, OH (US)

( * ) Notice: Subject to any disclaimer, the term of this patent is extended or adjusted under 35 U.S.C. 154(b) by 0 days.

(21) Appl. No.: 14/644,573

(22) Filed: Mar. 11, 2015

(65) Prior Publication Data

US 2015/0354187 A1 Dec. 10, 2015

Related U.S. Application Data

(60) Provisional application No. 61/951,970, filed on Mar. 12, 2014.

(51) Int. Cl.

| | |
|---|---|
| ***E03B 1/00*** | (2006.01) |
| ***E03C 1/04*** | (2006.01) |
| ***E03C 1/046*** | (2006.01) |

(52) U.S. Cl.

CPC ..... *E03C 1/0408* (2013.01); *E03C 1/0404* (2013.01); *E03C 1/046* (2013.01); *Y10T 137/87579* (2015.04)

(58) Field of Classification Search

CPC ..... E03C 1/0404; E03C 1/0408; E03C 1/046
USPC ..... 137/88, 91, 92, 98, 109, 101.11, 137/119.04, 237, 240, 246, 246.13, 603; 4/601, 605, 903
See application file for complete search history.

(56) References Cited

U.S. PATENT DOCUMENTS

| | | | | | |
|---|---|---|---|---|---|
| 1,740,879 | A * | 12/1929 | Sonner | E03C 1/046 | 137/268 |
| 3,454,229 | A * | 7/1969 | Armond | E03C 1/046 | 137/892 |
| 4,607,793 | A * | 8/1986 | Eberle | E03C 1/046 | 239/318 |
| 5,125,577 | A * | 6/1992 | Frankel | E03C 1/02 | 239/211 |
| 6,006,374 | A * | 12/1999 | Winnett | E03C 1/046 | 239/312 |
| 6,904,627 | B2 * | 6/2005 | Lee | A47K 5/02 | 4/559 |
| 7,611,070 | B2 * | 11/2009 | Paoluccio | B05B 7/0425 | 239/10 |
| 8,251,090 | B2 * | 8/2012 | Lin | F16K 23/00 | 137/118.03 |
| 8,453,667 | B2 * | 6/2013 | Li | F15D 1/025 | 137/101.11 |
| 2009/0045268 | A1 * | 2/2009 | Selander | B05B 7/2454 | 239/310 |

* cited by examiner

*Primary Examiner* — John K Fristoe, Jr.
*Assistant Examiner* — Reinaldo Sanchez-Medina

(57) ABSTRACT

A valve actuator assembly efficiently dispenses liquid soap to create bubbles. A faucet has a spout body including a valve port and seat. A valve gate door on an inlet side of the valve port is movable vertically relatively to the valve port between open and closed positions. The valve actuator assembly includes a hollow valve stem extending vertically from an exterior of the spout body into an interior thereof at the outlet side of the valve port. The hollow valve stem contains at least one orifice communicating with a hollow interior of the valve stem. The at least one orifice is exposed to a path of liquid flow from the valve port in the lower open position. A knob of the valve actuator assembly has an upwardly open funnel opening that communicates with the hollow interior of the valve stem to receive a liquid soap.

2 Claims, 4 Drawing Sheets

BUBBLE FAUCET

CROSS REFERENCE TO RELATED APPLICATIONS

This application claims the benefit of priority to U.S. Provisional Patent Application No. 61/951,970, filed on Mar. 12, 2014, entitled Bubble Faucet, the entire contents of which are hereby incorporated by reference.

BACKGROUND OF THE INVENTION

1. Field of the Invention

The present application pertains to a water fixture having a shower diverter, and more particularly to an integral shower diverter that meters liquid soap into bath water.

2. Description of the Related Art

To make bathing more hygienic and entertaining, liquid soap is often added to generate bubbles and foam. Manually dispensing is problematic in that the concentrated liquid soap does not receive sufficient agitation from the flow of water from the faucet to fully mix and froth.

SUMMARY OF THE INVENTION

In one aspect, the present disclosure provides a water fixture including a spout body having a valve port and seat. A valve gate is disposed on an inlet side of the valve port movable vertically relatively to the valve port between an upper closed position and a lower open position. A hollow valve stem extends vertically from an exterior of the spout body into an interior thereof at the outlet side of the valve port. The hollow valve stem contains at least one orifice communicating with a hollow interior of the valve stem and that is exposed to a path of liquid flow from the valve port in the lower open position. A knob has an upwardly open funnel opening that communicates with the hollow interior of the valve stem to receive a liquid soap.

According to another aspect, the present disclosure provides a valve actuator assembly that efficiently dispenses liquid soap to create bubbles. A faucet has a spout body including a valve port and seat. A valve gate door on an inlet side of the valve port is movable vertically relatively to the valve port between open and closed positions. The valve actuator assembly includes a hollow valve stem extending vertically from an exterior of the spout body into an interior thereof at the outlet side of the valve port. The hollow valve stem contains at least one orifice communicating with a hollow interior of the valve stem. The at least one orifice is exposed to a path of liquid flow from the valve port in the lower open position. A knob of the valve actuator assembly has an upwardly open funnel opening that communicates with the hollow interior of the valve stem to receive a liquid soap.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
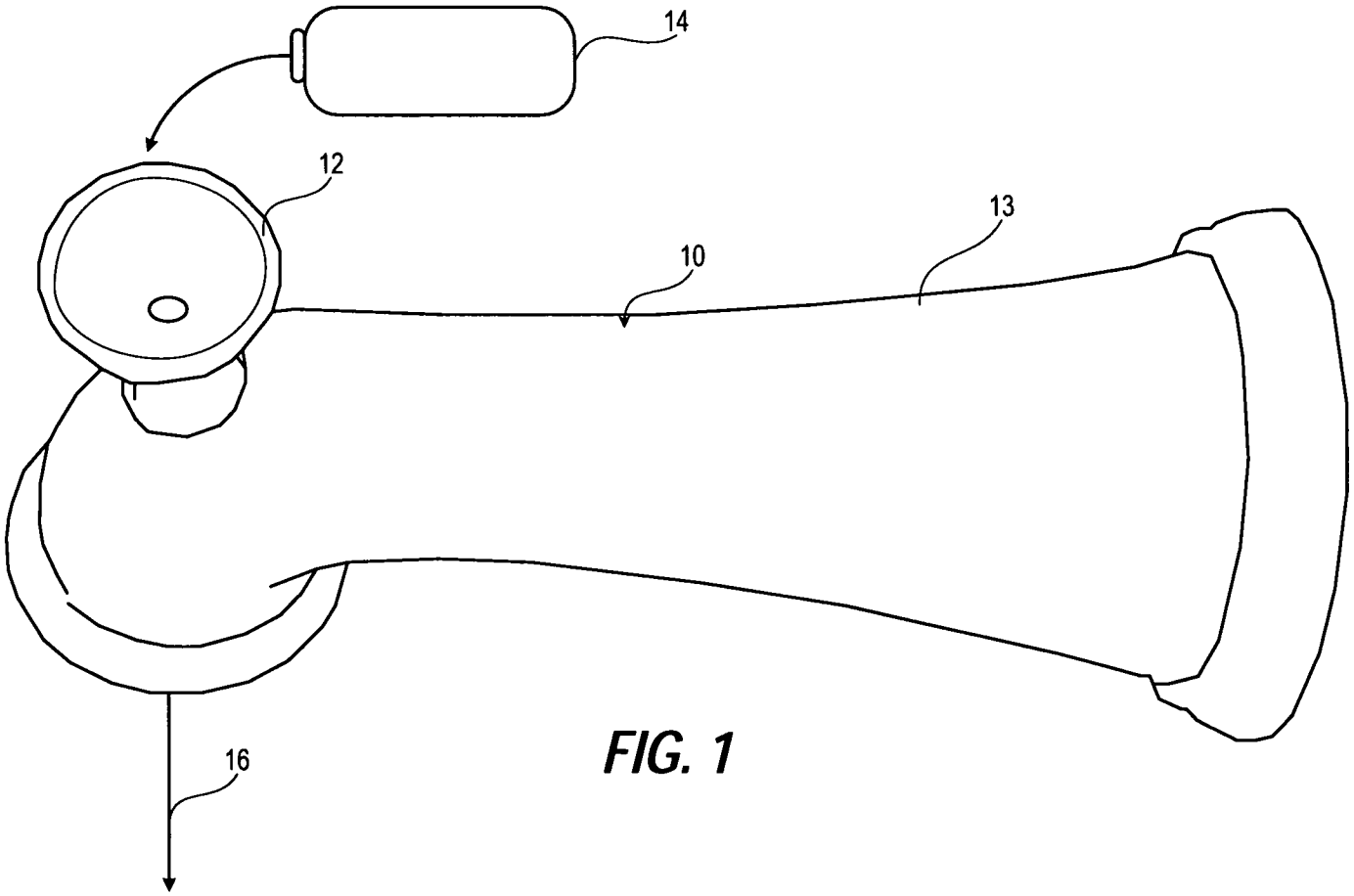
FIG. 1 illustrates a top isometric view of a water fixture having a shower diverter knob that receives liquid soap, according to one embodiment.

Turning to the drawings, FIG. 1 illustrates a water fixture 10 having a shower diverter knob 12 that extends externally from a spout body 13 for serving as a conventional shower diverter control. The present innovation provides that the shower-diverter knob 12 also can receive liquid soap 14, according to one embodiment. The liquid soap 14 is slowly introduced directly into the flow of water 16 in order to mix well and to generate a substantial quantity of bubbles and froth.

Figure 2:
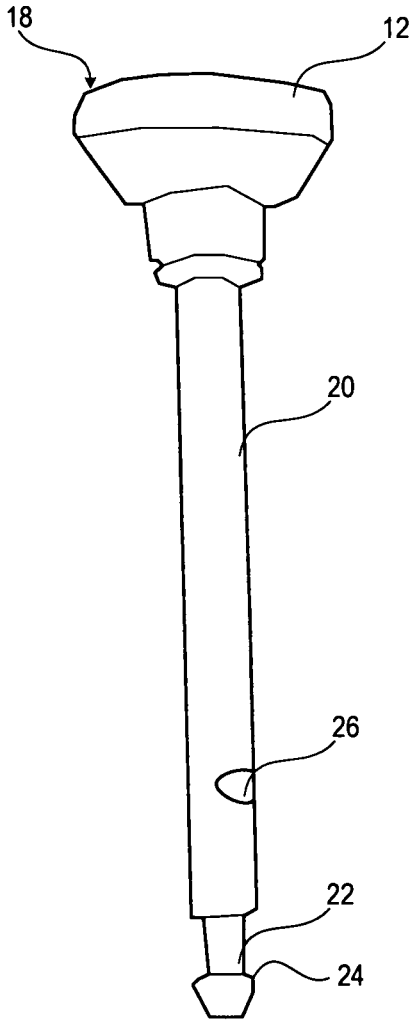
FIG. 2 illustrates a side view of a valve actuator having the shower diverter knob of FIG. 1, according to one embodiment.
Figure 3:
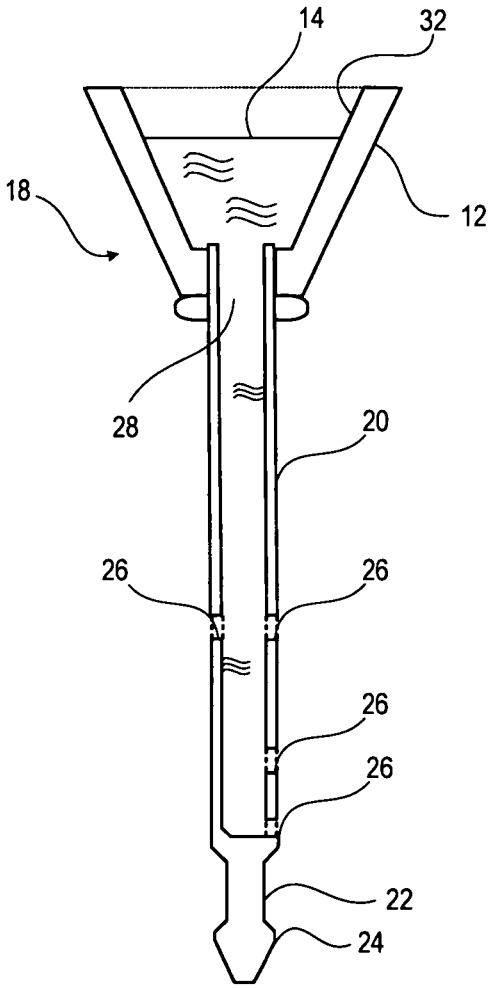
FIG. 3 illustrates a side view in vertical cross section of the valve actuator of FIG. 2, according to one embodiment.

FIGS. 2-3 illustrate a valve actuator assembly 18 that includes the shower diverter knob 12 and a hollow valve stem 20 that terminates in a narrow shaft 22 terminated in a tapered head 24 for assembling by insertion into the water fixture 10 (FIG. 1). With particular reference to FIG. 3, the hollow valve stem 20 contains at least one orifice 26 communicating with a hollow interior 28 (FIG. 3) of the hollow valve stem 20. The shower diverter knob 12 of the valve actuator assembly 18 has a funnel opening 32 that communicates with the hollow interior 28 of the hollow valve stem 20 to receive the liquid soap 14. In the exemplary embodiment, the funnel opening 32 of the shower diverter knob 12 and hollow interior 28 drain out entirely from the at least one orifice 26, which can be expedited by flushing with water after use.

Figure 4:
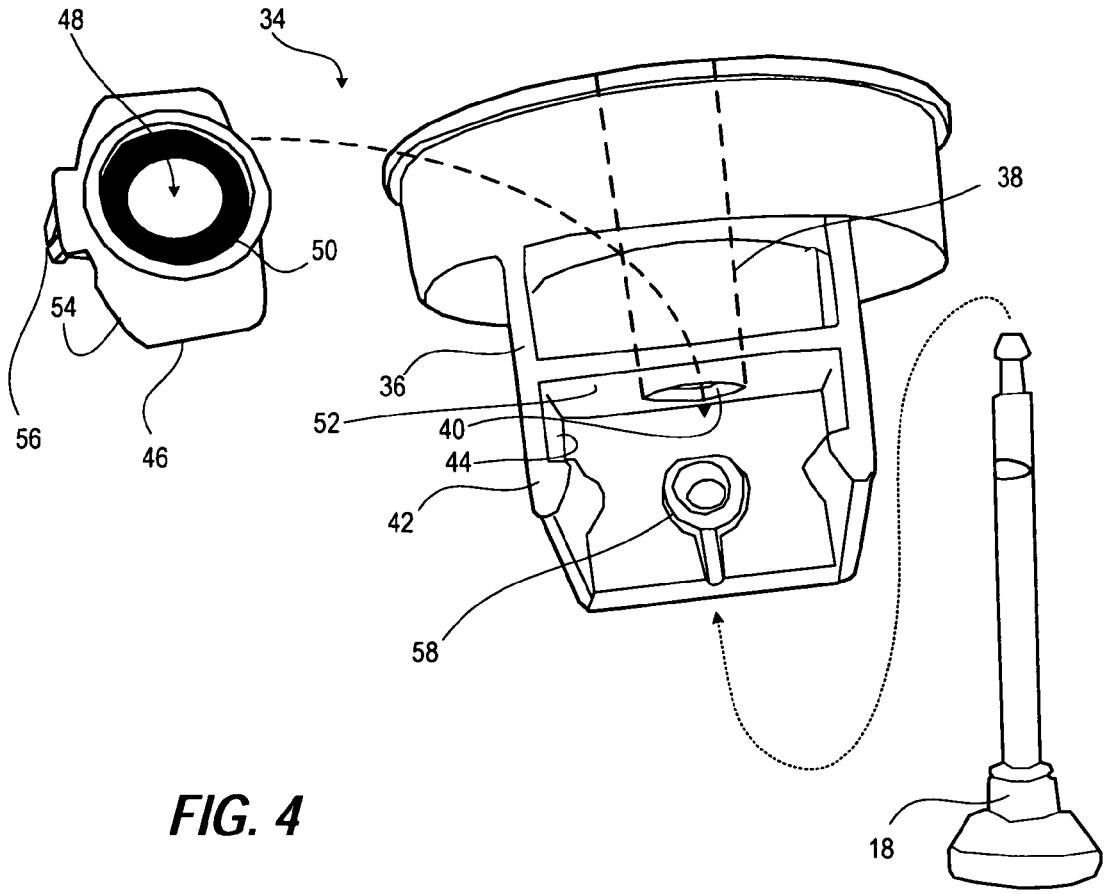
FIG. 4 illustrates a disassembled view of a gate valve of the water fixture of FIG. 1, according to one embodiment.
Figure 5:
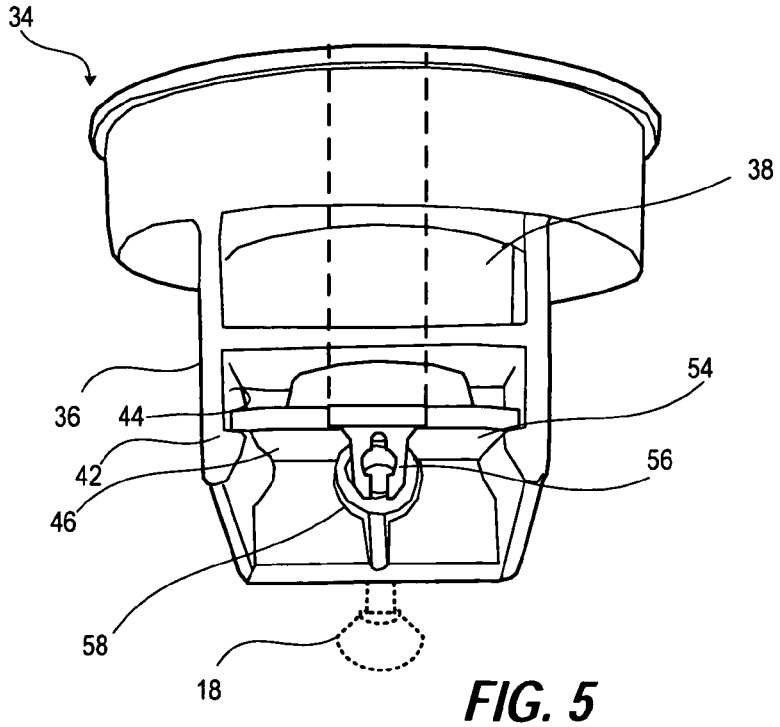
FIG. 5 illustrates an assembled view of the gate valve of FIG. 4, according to one embodiment.

FIGS. 4-5 illustrate a generally-known faucet shutoff assembly 34 of the water fixture 10 (FIG. 1), according to one embodiment, that is actuated by the present innovation of the valve actuator assembly 18. With particular reference to FIG. 4, the faucet shutoff assembly 34 has a molded body 36 including an upstream mating conduit 38 that receives water supplied to the water fixture 10 (FIG. 1) and presents pressurized water to a valve port 40. A gate valve body 42 is provided by a generally rectangular recess 44 formed in the molded body 36 of the faucet shutoff assembly 34 adjacent and downstream 34 to the valve port 40. A valve gate door 46 is sized to be received in the generally rectangular recess 44 that serves as a valve seat for vertical movement. An aft-oriented circular recess 48 in valve gate door 46 receives an annular seal 50 that dynamically seals to a planar wall 52 surrounding the valve port 40. A forward face 54 of the valve gate door 46 has gripping fingers 56 for resiliently allowing the tapered head 24 of the valve actuator assembly 18 to pass through and to then grip the narrow shaft 22 for coordinated vertical movement. The valve actuator assembly 18 is inserted into a vertical cylindrical guide 58 formed into the molded body 36 at a downstream opening 60 (FIG. 7) in the generally rectangular recess 44.

Figure 6:
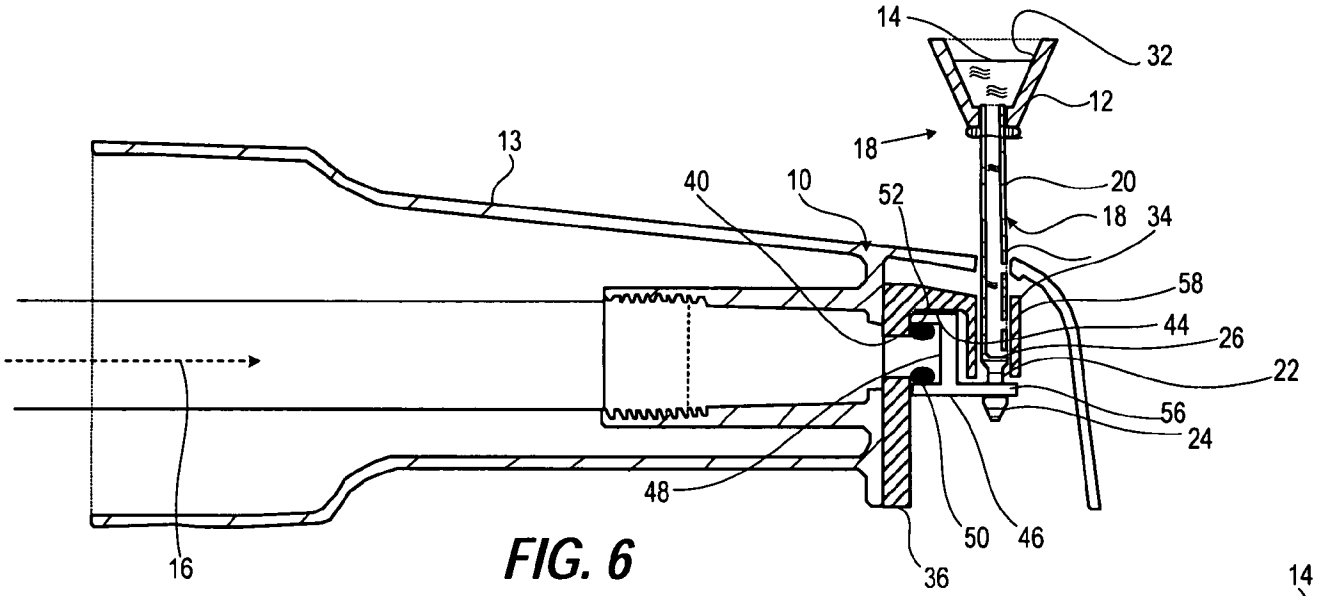
FIG. 6 illustrates a side view in vertical cross section of an example water fixture with the gate valve in an upper closed position, according to one embodiment.

FIG. 6 illustrates the water fixture 10 having been supplied pressurized water. The valve actuator assembly 18 is being used in its conventional function of closing the valve gate door 46. The valve actuator assembly 18 remains in the upper, closed position until water pressure is removed or until the valve actuator assembly 18 is manually lowered. The at least one orifice 26 is not exposed to flow of water, which eliminates or reduces dispensing of the liquid soap 14.

Figure 7:
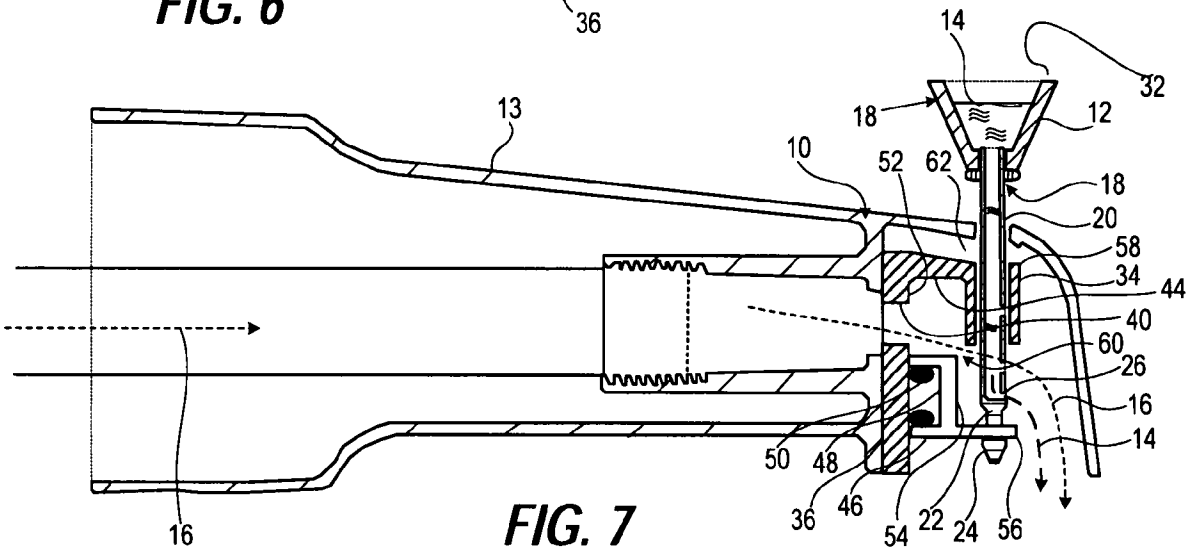
FIG. 7 illustrates a side view in vertical cross section of an example water fixture with the gate valve in a lower open position, according to one embodiment.

FIG. 7 illustrates the water fixture 10 having been supplied pressurized water. The valve actuator assembly 18 is in the lower, open position allowing the valve port 40 to be unobstructed by the valve gate door 46. The hollow valve stem 20 extends vertically from an exterior of the spout body 13 into an interior 62 thereof at the outlet side of the valve port 40. The at least one orifice 26 is exposed to a path of liquid (water) flow from the valve port 40 in the lower open position to draw a viscous liquid soap 14 from the hollow valve stem 20 and funnel opening 32 of the valve actuator assembly 18. The size of the orifice 26 and viscosity of the liquid soap 14 may be selected for a rate of dispensing based upon gravity and/or eduction by the venture effect around the hollow valve stem 20.

In the above described flow chart, one or more of the methods may be embodied in a computer readable device containing computer readable code such that a series of functional processes are performed when the computer readable code is executed on a computing device. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A water fixture, comprising:

spout body having a valve port and seat;

valve gate disposed on an inlet side of the valve port movable vertically relatively to the valve port between an upper closed position and a lower open position;

a hollow valve stem extending vertically from an exterior of the spout body into an interior thereof at the outlet side of the valve port and containing at least one orifice communicating with a hollow interior of the valve stem and that is exposed to a path of liquid flow from the valve port in the lower open position; and a knob having an upwardly open funnel opening that communicates with the hollow interior of the valve stem to receive a liquid soap.

2. A valve actuator assembly for a water fixture having a spout body including a valve port and seat, wherein a valve gate door is disposed on an inlet side of the valve port that is movable vertically relatively to the valve port between an upper closed position and a lower open position, the valve actuator assembly comprising:

a hollow valve stem extending vertically from an exterior of the spout body into an interior thereof at the outlet side of the valve port and containing at least one orifice communicating with a hollow interior of the valve stem and that is exposed to a path of liquid flow from the valve port in the lower open position; and a knob having an upwardly open funnel opening that communicates with the hollow interior of the valve stem to receive a liquid soap.

* * * * *